US011255348B2

(12) United States Patent
Maiorano et al.

(10) Patent No.: US 11,255,348 B2
(45) Date of Patent: Feb. 22, 2022

(54) BLOWER ASSEMBLY AND METHODS OF ASSEMBLING THE SAME

(71) Applicant: Regal Beloit America, Inc., Beloit, WI (US)

(72) Inventors: Anthony Maiorano, Clayton, OH (US); Sahand Pirouzpanah, San Diego, CA (US); Joseph A. Henry, Dayton, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 77 days.

(21) Appl. No.: 16/353,850

(22) Filed: Mar. 14, 2019

(65) Prior Publication Data

US 2020/0291965 A1 Sep. 17, 2020

(51) Int. Cl.
*F04D 29/70* (2006.01)
*F04D 17/16* (2006.01)

(52) U.S. Cl.
CPC ..... *F04D 29/703* (2013.01); *F04D 17/16* (2013.01)

(58) Field of Classification Search
CPC .. F04D 29/384; F04D 29/4213; F04D 29/282; F04D 29/162; F04D 17/16; F04D 29/703
See application file for complete search history.

(56) References Cited

U.S. PATENT DOCUMENTS

| | | | | |
|---|---|---|---|---|
| 5,143,516 | A | 9/1992 | Christensen | |
| 5,352,089 | A * | 10/1994 | Tokunaga | B60H 1/00471 415/119 |
| 5,779,440 | A * | 7/1998 | Stricker | F04D 29/2277 415/143 |
| 8,475,111 | B2 * | 7/2013 | Stagg | F04D 29/281 415/1 |
| 8,915,717 | B2 | 12/2014 | Stephan et al. | |
| 9,482,240 | B2 * | 11/2016 | Gerard | F04D 1/00 |
| 9,803,649 | B2 | 10/2017 | Ragg et al. | |
| 9,915,267 | B2 * | 3/2018 | Schrand | F04D 29/4226 |
| 2018/0142700 | A1 | 5/2018 | Hub et al. | |
| 2018/0202450 | A1 | 7/2018 | Schrand | |
| 2018/0335048 | A1 * | 11/2018 | Conrad | F04D 29/4213 |
| 2019/0293084 | A1 * | 9/2019 | Chang | F04D 25/12 |

FOREIGN PATENT DOCUMENTS

| | | | | |
|---|---|---|---|---|
| JP | 4650588 | B2 * | 3/2011 | F04D 29/162 |

* cited by examiner

*Primary Examiner* — Courtney D Heinle
*Assistant Examiner* — Andrew Thanh Bui
(74) *Attorney, Agent, or Firm* — Armstrong Teasdale LLP

(57) ABSTRACT

A blower assembly includes a fan assembly configured to rotate about an axis and having a fan inlet ring that at least partially defines a fan inlet and a fan outlet. The blower assembly also includes a frame assembly coupled to the fan assembly and a recirculation damper coupled to the frame assembly. The recirculation damper and the fan inlet ring define an axial gap therebetween to reduce recirculation of an airflow discharged from the fan outlet.

20 Claims, 5 Drawing Sheets

BLOWER ASSEMBLY AND METHODS OF ASSEMBLING THE SAME

BACKGROUND

The embodiments described herein relate generally to blower assemblies, and more particularly, to blower assemblies that reduce noise and increase efficiency in forced air or air circulating systems.

Many known commercial ventilation, heating, and air conditioning systems require air propulsion units. In addition to providing movement of air for such systems, air propulsion units may be used in combination with condenser units or to supplement other heat transfer operations. Some known air propulsion units are motor driven fans. These fans may be, for example, a plenum wheel driven by an electric motor.

At least some known blower assemblies include a plug fan with a plurality of circumferentially-spaced backward curved blades that are rotated by a motor to intake an airflow in an axial direction and exhaust the airflow in a radial direction. In such a configuration, the airflow exiting the fan may attach to the walls of the flow passage as soon as it exits the fan. As a result, an area of air recirculation may form which increases overall noise and also decreases the efficiency on the system.

At least some known blower assemblies include features on the fan or upstream of the fan to reduce recirculation. For example, at least some known fans include flow straighteners at the inlet of the fan. However, such flow straighteners can be expensive to manufacture and install. Furthermore, at least some known fans include specially designed blade profiles and features that are meant to reduce recirculation. However, such blade features may be difficult and expensive to manufacture.

BRIEF DESCRIPTION

In one aspect, a blower assembly having an axis of rotation is provided. The blower assembly includes a fan assembly configured to rotate about the axis and including a fan inlet ring that at least partially defines a fan inlet and a fan outlet. The blower assembly also includes a frame assembly coupled to the fan assembly and a recirculation damper coupled to the frame assembly. The recirculation damper and the fan inlet ring define an axial gap therebetween to reduce recirculation of an airflow discharged from the fan outlet.

In another aspect, a method of assembling a blower assembly having an axis of rotation is provided. The method includes coupling a fan assembly to a frame assembly. The fan assembly is configured to rotate about the axis and includes a fan inlet ring that at least partially defines a fan inlet and a fan outlet. The method also includes coupling a recirculation damper to an inlet plate of the frame assembly. The recirculation damper includes a radially inner portion, a radially outer portion, and a crown portion positioned therebetween. The crown portion being a portion of the recirculation damper positioned furthest from the inlet plate. The recirculation damper is coupled with respect to the fan inlet ring to define an axial gap between the crown portion and the fan inlet ring to reduce recirculation of an airflow discharged from the fan outlet.

In yet another aspect, a recirculation damper is provided. The recirculation damper is for use with a blower assembly having a frame assembly and a fan assembly including a fan inlet ring and an axis of rotation. The recirculation damper includes a radially inner portion configured to be coupled to a frame inlet ring of the frame assembly and a radially outer portion configured to be coupled to an inlet plate of the frame assembly. The recirculation damper also includes a crown portion positioned between the radially inner portion and the radially outer portion. The crown portion being a portion of the recirculation damper positioned furthest from the inlet plate. An axial gap is configured to be defined between the crown portion and the fan inlet ring to reduce recirculation of an airflow discharged from the fan outlet.

DETAILED DESCRIPTION

The present disclosure provides blower assemblies with improved structural designs that improve air flow downstream of the fan. Specifically, one blower assembly includes a recirculation damper that reduces recirculation and other downstream disturbances in the airflow. which results in increased efficiency. More specifically, the recirculation damper is positioned with respect to the inlet ring of the fan to define an axial gap therebetween that allows the airflow exiting the fan to attach to the surface of the recirculation damper and be guided downstream without forming eddies or vortices caused by recirculation. Such a reduction of recirculation results in efficiency increases and noise reduction of the blower assembly due to the ability to operate at lower torque requirements, thus increasing the efficiency, and also at lower speeds, thus reducing the noise levels.

Figure 1:
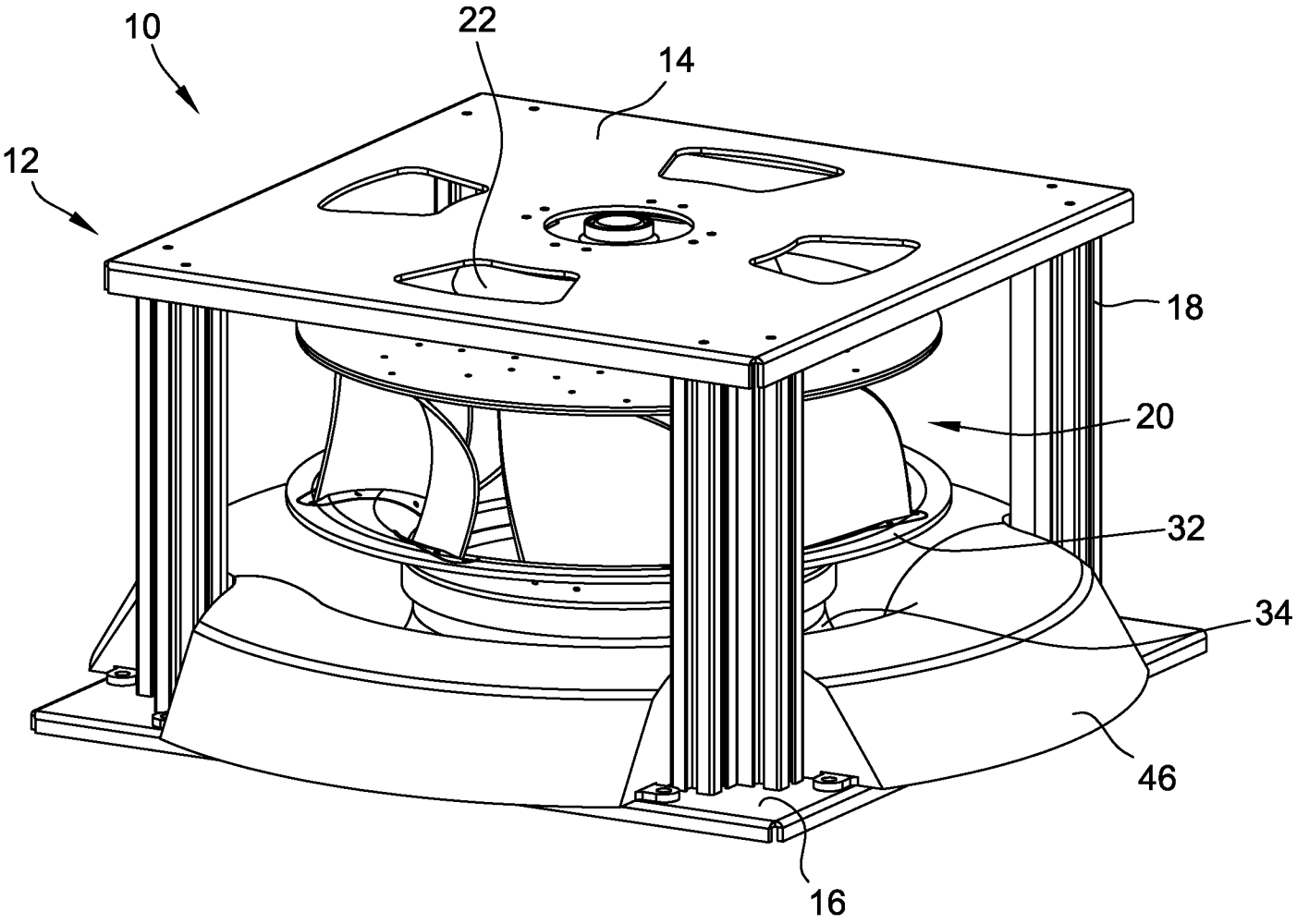
FIG. 1 is a perspective view of one embodiment of a blower assembly.
Figure 2:
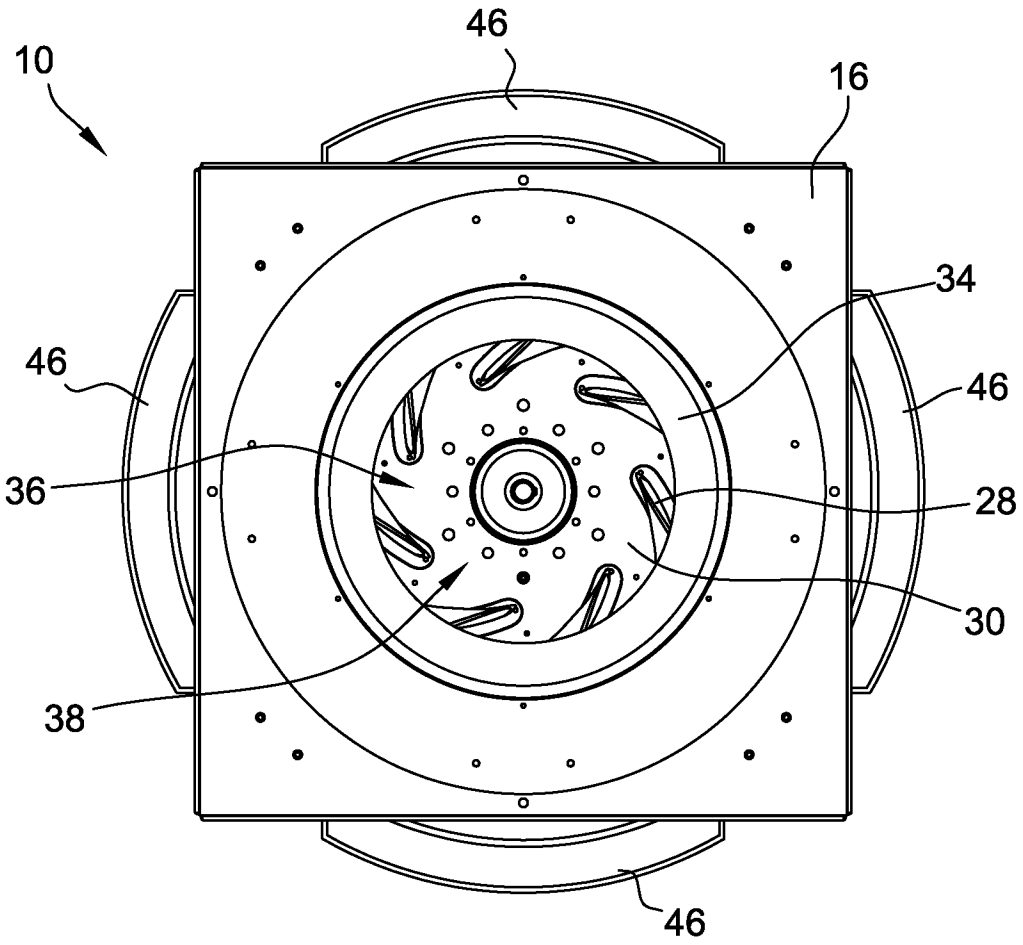
FIG. 2 is a front view of the blower assembly of FIG. 1.
Figure 3:
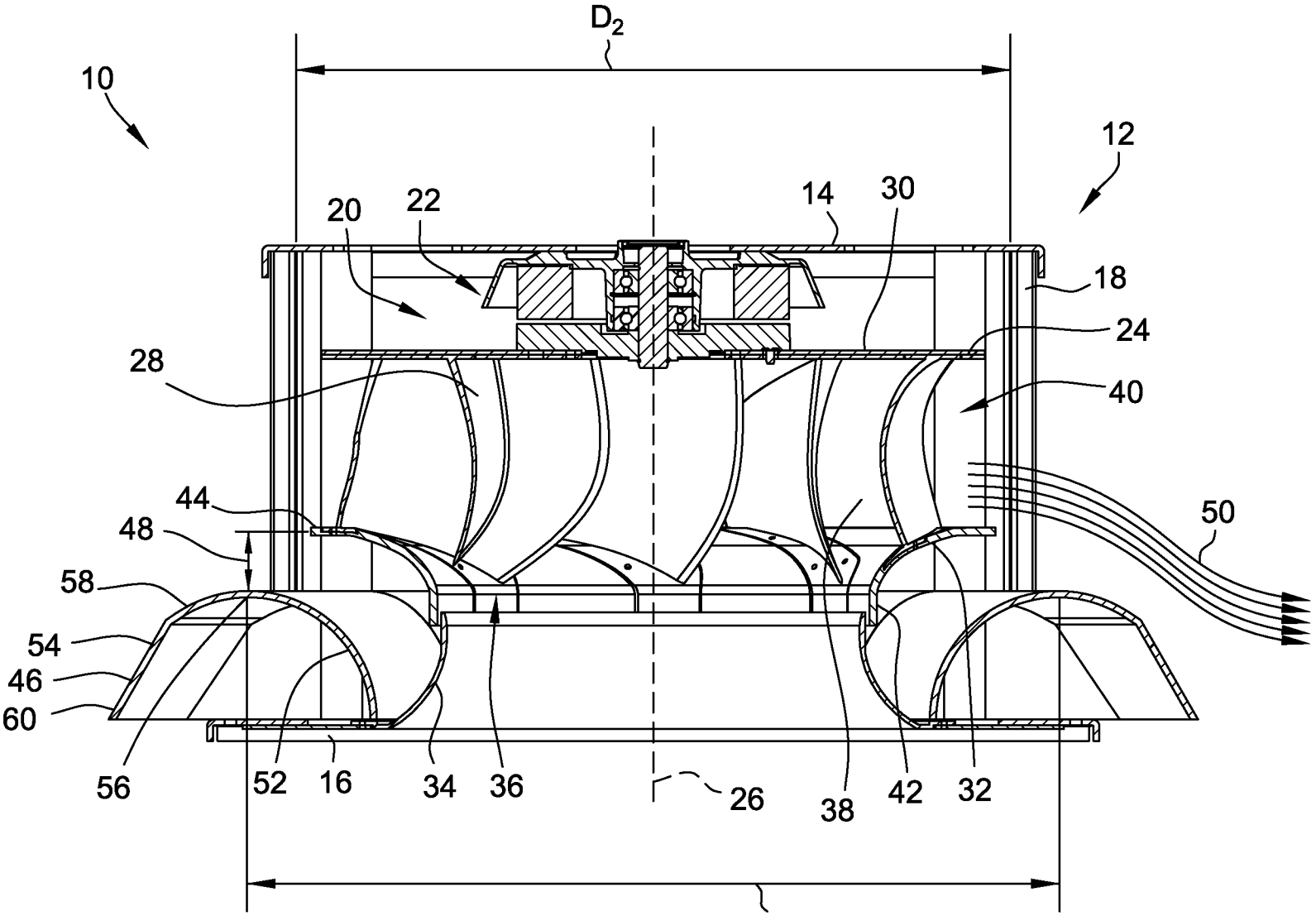
FIG. 3 is a cross-sectional view of the blower assembly of FIG. 1.
Figure 4:
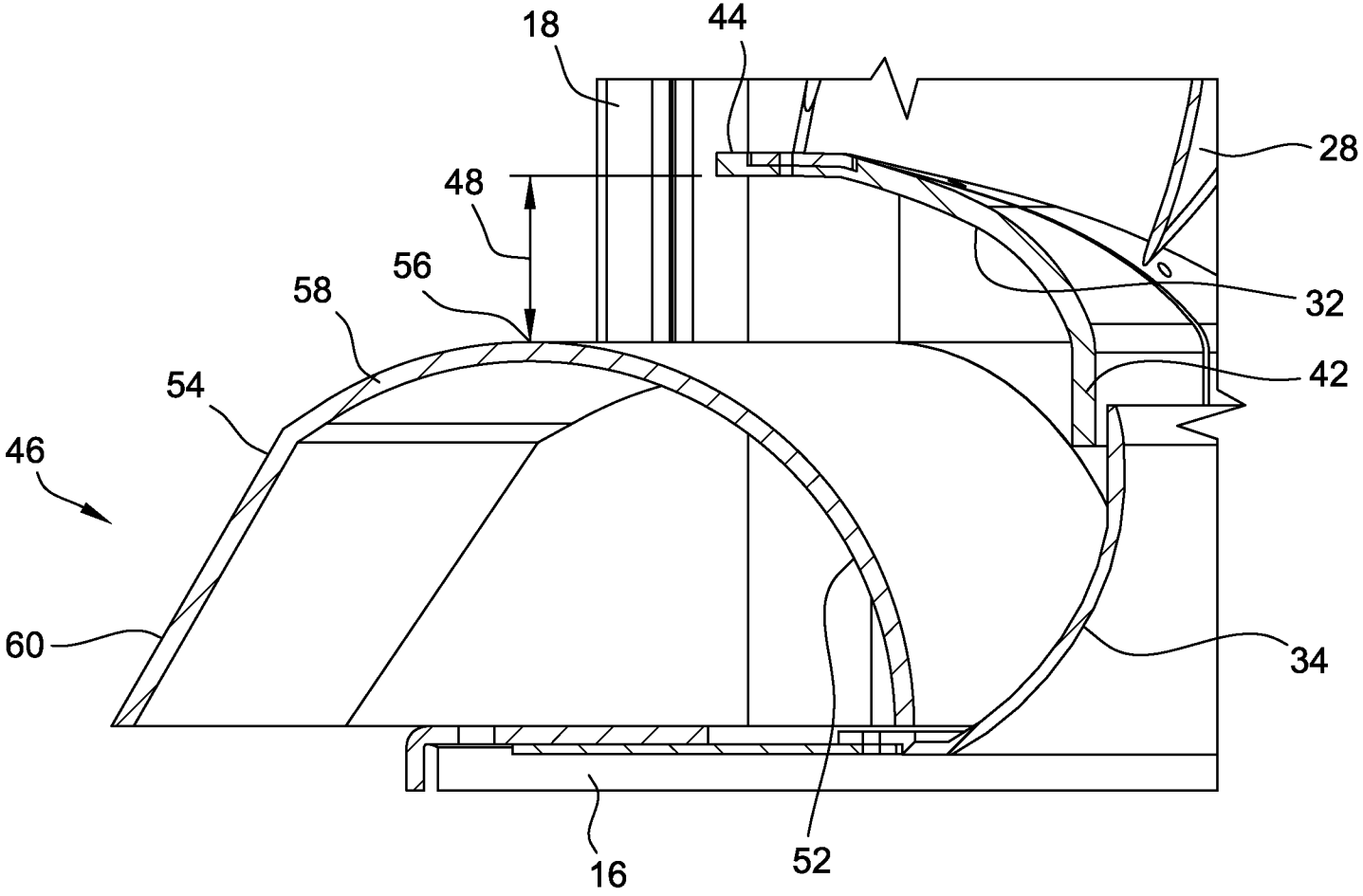
FIG. 4 is an enlarged cross-sectional view of a portion of the blower assembly outlined by box 4-4 shown in FIG. 3.

FIG. 1 is a perspective view of one embodiment of a blower assembly 10, FIG. 2 is a front view of blower assembly 10, FIG. 3 is a cross-sectional view of blower assembly 10, FIG. 4 is an enlarged cross-sectional view of a portion of blower assembly 10 outlined by box 4-4 shown in FIG. 3. In this embodiment, blower assembly 10 is configured to produce a flow of air for a forced air system, e.g., a commercial or industrial HVAC system. Blower assembly 10 includes a frame assembly 12 having a rear plate 14, an inlet plate 16, and a plurality of frame members 18 extending therebetween. Furthermore, blower assembly 10 includes a fan assembly 20 having a motor 22 and a fan 24 configured to rotate about an axis 26. In the exemplary embodiment, fan 24 includes a plurality of blades 28 coupled between a rear plate 30 and an inlet ring 32. Motor 22 is coupled to frame rear plate 14 and fan rear plate 30 to secure fan assembly 20 to frame assembly 12. As best shown in FIG. 3, frame assembly 12 includes an inlet ring 34 coupled to inlet plate 16 and extending toward inlet ring 30 of fan 24. Inlet rings 32 and 34 combine to form an inlet 36 to fan assembly 20 through which air flows into a fan chamber 38 defined by rear plate 30, inlet ring 32, and blades 28. In one embodiment, fan 24 is a backward curved plug fan. Alternatively, fan 24 may have any suitable blade shape, for example a backward curved blade, an airfoil blade, a backward inclined blade, a forward curved blade, and a radial blade, that enables fan assembly 10 to operate as described herein.

Rear plate 30 and inlet ring 32 are coaxial or substantially coaxial and configured to rotate about a center axis 26. Blades 28 are attached to rear plate 30 and/or inlet ring 32 such that each blade 28 extends between rear plate 30 and inlet ring 32. In one embodiment, each blade 28 may be attached to rear plate 30 and/or inlet ring 32 via features formed in rear plate 30 and/or inlet ring 32 such as an opening, e.g., a groove or a slot, configured to restrict an amount of movement of blade 28 between rear plate 30 and inlet ring 32 while permitting blades 28 to operate as described herein. Blades 28 may be coupled to rear plate 30 and/or inlet ring 32 in any manner that permits fan 24 to operate as described herein. During rotation, blades 28 are configured to pull in air through inlet 36 along center axis 26 and eject the air radially outward through an outlet 40 located between adjacent blades 28. Specifically, inlet ring 32 includes an inlet end 42 that at least partially defines inlet 36 and an outlet end 44 that at least partially defines outlet 40.

In the exemplary embodiment, blower assembly 10 also includes a recirculation damper 46 coupled to frame assembly 12 such that recirculation damper 46 and inlet ring 32 define an axial gap 48 therebetween. As described here, gap 48 facilitates reducing recirculation of an airflow 50 discharged from outlet 40. Specifically, recirculation damper 46 is coupled to at least one of inlet plate 16 and inlet ring 34 of frame assembly 12 such that recirculation damper 46 circumscribes at least a portion of inlet ring 34. In one embodiment, recirculation damper 46 is formed integrally with one of inlet plate 16 or inlet ring 34.

As best shown in FIGS. 3 and 4, recirculation damper 46 includes a radially inner portion 52, a, radially outer portion 54, and a crown portion 56 positioned radially therebetween. Crown portion 56 is defined as the portion of recirculation damper 46 positioned furthest from inlet plate 16. In one embodiment, radially inner portion 52 is coupled to inlet ring 34 and radially outer portion 54 is coupled to inlet plate 16. Specifically, the radially outermost portion of radially outer portion 54 overhangs inlet plate 16. In the exemplary embodiment, radially inner portion 52 is curved in shape between inlet ring 34 and crown portion 56. Furthermore, radially outer portion includes a curved portion 58 extending from crown portion 56 and a linear portion 60 extending from curved portion 58 toward the axial plane of inlet plate 16. Alternatively, radially inner portion 52 and radially outer portion 54 may have any shape that facilitates operation of recirculation damper 46 as described herein.

In the exemplary embodiment, axial gap 48 is defined between outlet end 44 of inlet ring 32 and crown portion 56 of recirculation damper 46. Furthermore, crown portion 56 of recirculation damper 46 defines a first diameter D1 and outlet end 44 of inlet ring 32 defines a second diameter D2 that is less than first diameter D1 such that crown portion 56 is positioned radially outward of outlet end 44. In the exemplary embodiment, axial gap 48 is within a range of between approximately 0.5 inches and approximately 6.0 inches. More specifically, axial gap 48 is within a range of between approximately 0.5 inches and approximately 2.0 inches. Generally, axial gap 48 is any size that facilities operation of blower assembly 10 as described herein.

During operation, air enters blower assembly 10 through central air inlet 36 and is deflected radially outward from central axis 26 toward blades 28. Blades 28 are configured to pull the air through inlet 36 into central chamber 38 of fan 24. The air passes through channels between blades 28 and is forced outward through outlet 40 due to the centrifugal force generated by rotating blades 28. In addition, in some known fans, the volume of airflow forced outward changes with respect to the speed of the fan's rotation.

As the airflow 50 exits outlet 40, recirculation damper 46 is shaped such that airflow 50 attaches to recirculation damper 46 to guide it out of fan 24. More specifically, airflow 50 forms a laminar boundary layer on crown portion 56 and radially outer portion 54 of recirculation damper 46. As such, recirculation damper 46 provides a structure to which airflow 50 can attach and, therefore reduces the formation of eddies and vortices caused by recirculation. As described herein, recirculation of the airflow exiting the fan can cause efficiency losses and also increase the noise level generated by the blower assembly. However, in the exemplary embodiment, recirculation damper 46 guides airflow 50 from outlet 40 along radially outer portion 54 and prevents or reduces recirculation of airflow 50 proximate inlet rings 32 and 34 and inlet plate 16. Such a reduction of recirculation results in efficiency increases and noise reduction of blower assembly 10. Specifically, the reduction in recirculation and turbulence enables fan 24 to operate at lower torque requirements, thus increasing the efficiency of fan 24. Similarly, the reduction in recirculation and turbulence enables fan 24 to operate at lower speeds, thus reducing the noise levels generated by fan 24.

Figure 5:
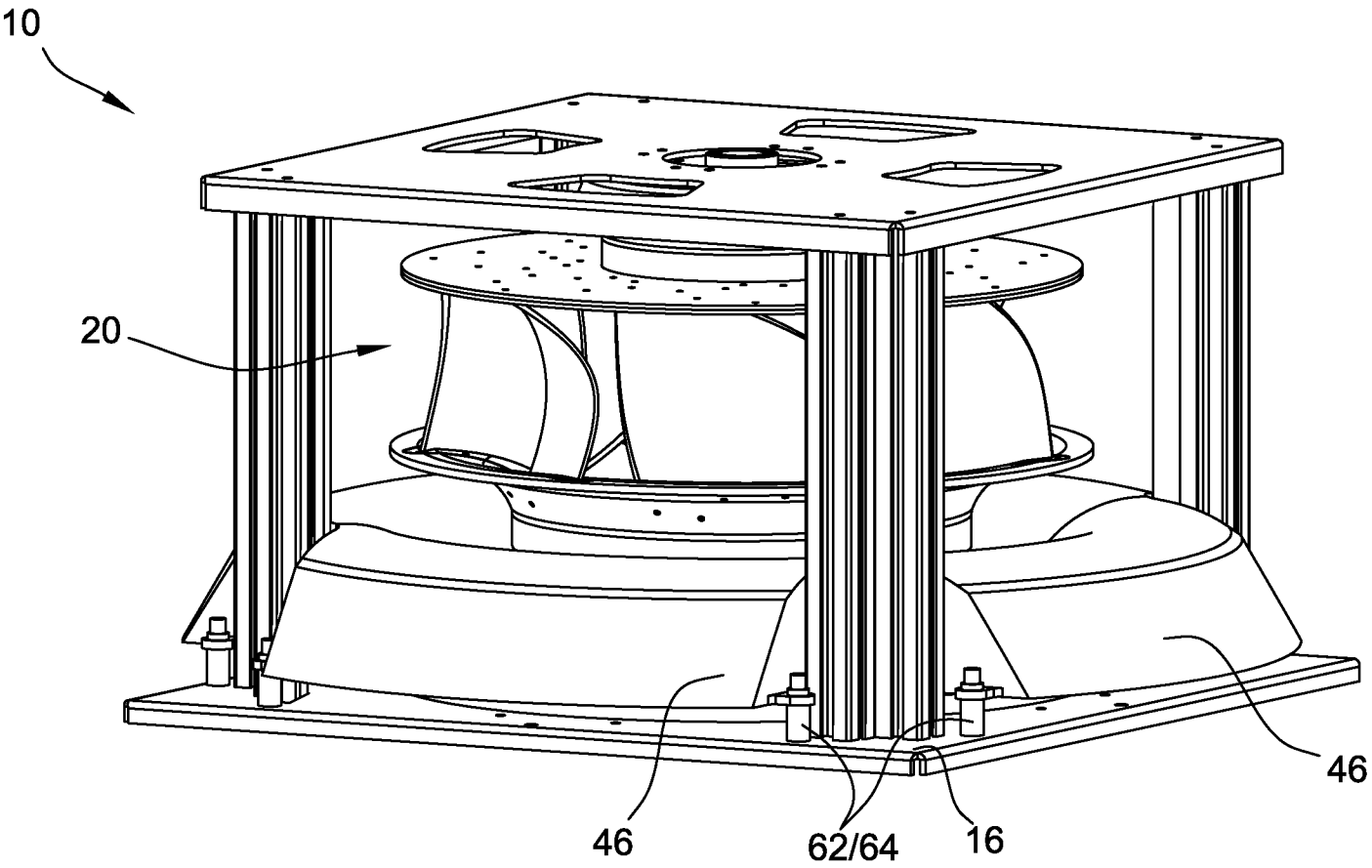
FIG. 5 is a perspective view of the blower assembly of FIG. 1 including an exemplary adjustment mechanism.

FIG. 5 is a perspective view of blower assembly 10 including an exemplary adjustment mechanism 62. In the exemplary embodiment, adjustment mechanism 62 adjusts the position of recirculation damper 46 with respect to inlet ring 32 to adjust the size of axial gap 48. The adjustability of recirculation damper 46 enables a user to customize the size of gap 48 to tune the performance of blower assembly 10 according to the user's preferences. In one embodiment, adjustment mechanism 62 includes a plurality of spacers 64 coupled between inlet plate 16 of frame assembly 12 and recirculation damper 46. The amount of spacers 64 used will vary based on the desired size of gap 48. That is, spacers 64 enable the axial position of recirculation damper 46 to be adjusted based on desired performance to optimize efficiency and/or noise. Alternatively, adjustment mechanism 62 is any mechanism that enables adjusting the position of recirculation damper 46 with respect to inlet ring 32.

The present disclosure provides blower assemblies with improved structural designs that improve air flow downstream of the fan. Specifically, one blower assembly includes a recirculation damper that reduces recirculation and other downstream disturbances in the airflow. which results in increased efficiency. More specifically, the recirculation damper is positioned with respect to the inlet ring of the fan to define an axial gap therebetween that allows the airflow exiting the fan to attach to the surface of the recirculation damper and be guided downstream without forming eddies or vortices caused by recirculation. Such a reduction of recirculation results in efficiency increases and noise reduction of the blower assembly due to the ability to operate at lower torque requirements, thus increasing the efficiency, and also at lower speeds, thus reducing the noise levels.

The embodiments described herein relate to a blower assembly and methods of assembling the same. More specifically, the embodiments relate to blower assemblies that includes a backward curved fan and recirculation damper that reduces or prevents airflow recirculation at the outlet of the fan to improve the efficiency and reduce the noise level of the blower assembly. More particularly, one embodiment relates to positioning the recirculation damper proximate an inlet ring of the fan to define an axial gap therebetween to reduce recirculation of the airflow discharged from the fan outlet. The methods and apparatus are not limited to the specific embodiments described herein, but rather, components of apparatus and/or steps of the methods may be utilized independently and separately from other components and/or steps described herein. For example, the methods may also be used in combination with a forward curved fan or blower assembly, and are not limited to practice with only the backward curved fan as described herein. In addition, the embodiment can be implemented and utilized in connection with many other HVAC applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blower assembly having an axis of rotation and comprising:

a fan assembly configured to rotate about said axis and comprising a fan inlet ring comprising an inlet end that at least partially defines a fan inlet and an outlet end that at least partially defines a fan outlet;

a frame assembly coupled to said fan assembly and comprising at least one frame member; and a recirculation damper coupled to said frame assembly, wherein said recirculation damper comprises a crown portion comprising a portion of said recirculation damper positioned axially nearest said fan inlet ring outlet end to define an axial gap between said crown portion and said fan inlet ring outlet end to reduce recirculation of an airflow discharged from said fan outlet, wherein said crown portion is positioned radially outward of said fan inlet ring outlet end, wherein said recirculation damper comprises a recess configured to receive at least a portion of said at least one frame member.

2. The blower assembly according to claim 1, wherein said frame assembly comprises an inlet plate coupled to said recirculation damper, and wherein said recirculation damper comprises a radially inner portion and a radially outer portion positioned on opposing sides of said crown portion, said crown portion comprising a portion of said recirculation damper positioned furthest from said inlet plate.

3. The blower assembly according to claim 2, wherein said axial gap is defined between said crown portion and an axial plane parallel to said fan inlet ring outlet end.

4. The blower assembly according to claim 3, wherein said axial gap is within a range of between approximately 0.5 inches and approximately 6.0 inches.

5. The blower assembly according to claim 3, wherein said crown portion defines a first diameter and said fan inlet ring defines a second diameter less than the first diameter.

6. The blower assembly according to claim 1, wherein said recirculation damper at least partially circumscribes said fan inlet ring.

7. The blower assembly according to claim 1, wherein said frame assembly comprises an inlet plate and a frame inlet ring, said recirculation damper coupled to at least one of said inlet plate and said frame inlet ring.

8. The blower assembly according to claim 7, wherein said recirculation damper comprises a radially inner portion coupled to said frame inlet ring and a radially outer portion coupled to said inlet plate.

9. The blower assembly according to claim 1, further comprising an adjustment mechanism configured to adjust a position of said recirculation damper with respect to said fan inlet ring to adjust the axial gap.

10. The blower assembly according to claim 9, wherein said adjustment mechanism comprises a plurality of spacers coupled between said frame assembly and said recirculation damper.

11. A method of assembling a blower assembly having an axis of rotation, said method comprising:

coupling a fan assembly to a frame assembly, the fan assembly configured to rotate about the axis and including a fan inlet ring including an inlet end that at least partially defines a fan inlet and an outlet end that at least partially defines a fan outlet;

coupling a recirculation damper to an inlet plate of the frame assembly, the recirculation damper including a radially inner portion, a radially outer portion, a crown portion positioned therebetween, the crown portion being a portion of the recirculation damper positioned axially nearest the fan inlet ring outlet end and radially outward of the fan inlet ring outlet end; and wherein coupling the recirculation damper comprises coupling the recirculation damper with respect to the fan inlet ring to define an axial gap between the crown portion and the fan inlet ring to reduce recirculation of an airflow discharged from the fan outlet, and wherein coupling the recirculation damper comprises extending at least one frame member from the inlet plate through a recess formed in the recirculation damper.

12. The method according to claim 11, wherein coupling the recirculation damper comprises coupling the recirculation damper to define the axial gap between the crown and an outlet end of the fan inlet ring.

13. The method according to claim 12, wherein coupling the recirculation damper comprises coupling the recirculation damper such that the crown is positioned radially outward of the outlet end of the fan inlet ring.

14. The method according to claim 11, wherein coupling the recirculation damper comprises coupling the recirculation damper to at least partially circumscribe the fan inlet ring.

15. The method according to claim 11, wherein coupling the recirculation damper comprises coupling the radially outer portion to the inlet plate and coupling the radially inner portion to a frame inlet ring.

16. The method according to claim 11, further comprising adjusting a position of the recirculation damper with respect to the fan inlet ring using an adjustment mechanism.

17. The method according to claim 11, adjusting the position of the recirculation damper comprises coupling a plurality of spacers between the inlet plate and the recirculation damper.

18. A recirculation damper for use with a blower assembly having a frame assembly including at least one frame member and a fan assembly including a fan inlet ring having an outlet end that at least partially defines a fan outlet and an axis of rotation, said recirculation damper comprising:

a radially inner portion configured to be coupled to a frame inlet ring of the frame assembly;

a radially outer portion configured to be coupled to an inlet plate of the frame assembly;

at least one recess configured to receive at least a portion of the frame member; and a crown portion positioned radially between the radially inner portion and the radially outer portion, the crown portion being a portion of the recirculation damper positioned axially furthest from the inlet plate and axially nearest the fan inlet ring outlet end, wherein said crown portion is positioned radially outward of said fan inlet ring outlet end, wherein an axial gap is configured to be defined between the crown portion and the fan inlet ring to reduce recirculation of an airflow discharged from the fan outlet.

19. The recirculation damper according to claim 18, wherein said radially inner portion is curved in shape between the frame inlet ring and the crown portion.

20. The recirculation damper according to claim 19, wherein said radially outer portion comprises a curved portion extending from the crown portion and a linear portion extending from the curved portion.

* * * * *